United States Patent [19]

Roos

[11] Patent Number: 4,997,347

[45] Date of Patent: Mar. 5, 1991

[54] PERISTALTIC MOTOR

[75] Inventor: William N. Roos, Colgate, Wis.

[73] Assignee: Autotrol Corporation, Milwaukee, Wis.

[21] Appl. No.: 464,093

[22] Filed: Jan. 12, 1990

[51] Int. Cl.[5] ..... F04B 43/12

[52] U.S. Cl. ..... 417/475; 417/477; 92/92

[58] Field of Search ..... 417/475, 476, 477; 418/45; 91/499, 500, 502; 92/90, 91, 92

[56] References Cited

U.S. PATENT DOCUMENTS

| | | | |
|---|---|---|---|
| 2,864,341 | 12/1958 | Novak . | |
| 2,893,356 | 7/1959 | Murray | 417/475 |
| 3,039,442 | 6/1962 | Hornschuch et al. . | |
| 3,358,609 | 12/1967 | Worth et al. . | |
| 3,431,864 | 3/1969 | Jones, Jr. | 417/475 |
| 3,723,030 | 3/1973 | Gelfand | 417/475 |
| 3,732,042 | 5/1973 | Buchholz | 417/477 |
| 4,289,459 | 9/1981 | Neeley et al. | 417/475 |
| 4,576,242 | 3/1986 | Mundell . | |
| 4,834,630 | 5/1989 | Godwin | 417/475 |

FOREIGN PATENT DOCUMENTS

| | | | |
|---|---|---|---|
| 2718528 | 2/1978 | Fed. Rep. of Germany | 92/90 |
| 2842737 | 4/1980 | Fed. Rep. of Germany | 92/89 |
| 2928110 | 1/1981 | Fed. Rep. of Germany | 92/90 |
| 0885740 | 11/1981 | U.S.S.R. | 92/90 |
| 0928071 | 5/1982 | U.S.S.R. | 92/89 |

*Primary Examiner*—Leonard E. Smith
*Assistant Examiner*—Eugene L. Szczecina, Jr.
*Attorney, Agent, or Firm*—Quarles & Brady

[57] ABSTRACT

A fluid motor is disclosed that has a housing with a body portion formed as a hollow circular cylinder. A series of peristaltic tubes are disposed in the housing with one end of each tube leading from an inlet manifold on the housing and with the other end of the tubes open to the hollow interior of the housing. The tubes are disposed about the inner perimeter of the cylindrical body. A pair of rollers engage with each tube. The rollers for each tube are mounted on the ends of arms that extend in diametrically opposite directions from a motor shaft journaled in the housing. The rollers for each tube are angularly displaced with respect to the rollers for the other tubes about the axis of the motor shaft. Fluid under pressure entering the inlet will cause the rollers to advance along the length of the tubes and thereby rotate the motor shaft.

9 Claims, 2 Drawing Sheets

FIG. 3
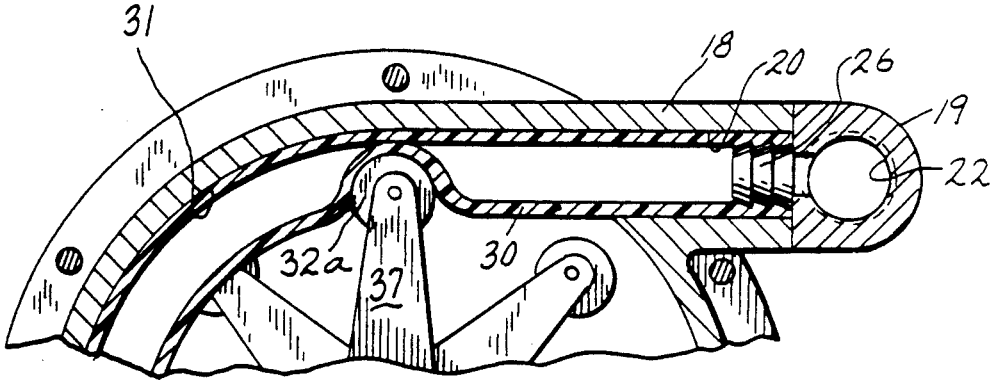
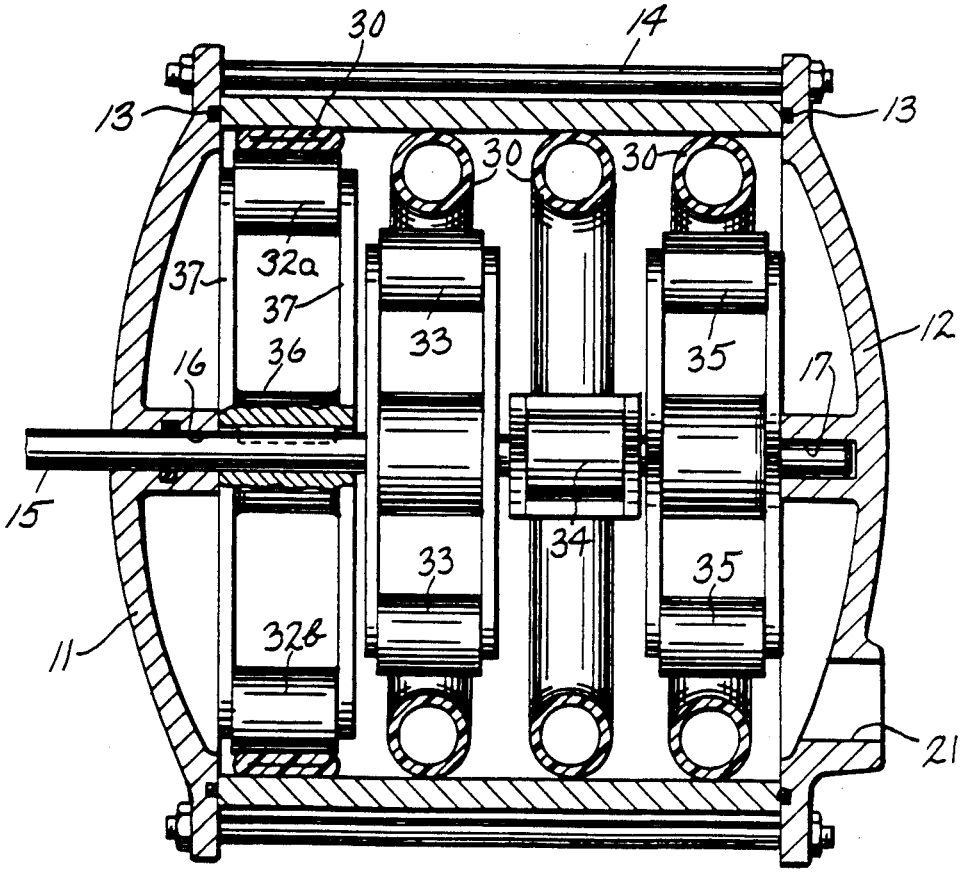
FIG. 4

PERISTALTIC MOTOR

BACKGROUND OF THE INVENTION

This invention relates to fluid motors, and more particularly to a motor driven by inlet fluid pressure operating through peristaltic tubes.

Peristaltic pumps are known in which fluid is moved through the flexible tubes in a manner simulating the peristaltic movement through the human digestive system. Typically, a roller travels along the length of the peristaltic tube and collapses the tube between the roller and a support to thereby force material in the tube from the inlet to an outlet. An example of such a peristaltic pump is found in U.S. Pat. No. 3,358,609 issued Dec. 19, 1967 to Worth, et al.

The use of peristaltic movement of fluids through flexible tubes to drive the output of a fluid motor is much less well known. Examples of such fluid motors are found in the following U.S. patents:

U.S. Pat. No. 2,864,341 issued Dec. 16, 1958 to Novak in which an output pin is driven in an arc defined by a rigid annular ring that contains the flexible tube and roller;

U.S. Pat. No. 3,039,442 issued June 19, 1962 to Hornschuch, et al. in which a series of expansible membranes are located about the inner perimeter of a stator and rollers projecting from a rotor mounted on a motor shaft travel along the inner peripheries of the membranes; and U.S. Pat. No. 4,576,242 issued Mar. 18, 1986 to Mundell which is similar in concept to the U.S. Pat. No. 3,039,442.

The flexible tube is a principal wear element of any peristaltic pump or motor. In addition to being constantly subjected to squeezing by the action of the rollers, the tube must also carry the pressure of the fluid moving through it. The forces on the tube are particularly pronounced in a fluid motor application because of the need to use relatively high fluid pressures in order to obtain acceptable work output on the motor shaft. The U.S. Pat. No. 4,576,242 attempts to equalize the pressure within and without the tube by the use of a separate external fluid lubricant and a pressure equalizing unit.

I have developed a peristaltic motor of simple construction in which the forces on the flexible tubes are held to a minimum and in which the output to the motor shaft is smooth and non-cyclical.

SUMMARY OF THE INVENTION

In accordance with the invention, a fluid motor includes a hollow enclosure having a fluid inlet and a fluid outlet, an output shaft journaled in the enclosure, a flexible tube connected at one end to the inlet and open at its other end to the hollow interior of the enclosure, a roller contacting the tube and movable along the length of the tube, with the roller being drivingly mounted to the shaft such that fluid under pressure at the inlet will cause the roller to advance along the length of the tube to thereby move the outlet shaft.

Further in accordance with the invention, the fluid motor may include a housing having a fluid inlet and a fluid outlet with an output shaft journaled in the housing and a plurality of flexible tubes in the housing each communicating at one end to the inlet and at their other end to the outlet, the flexible tubes being supported throughout their length along one side of the tubes, together with a roller for each tube mounted to the shaft with the rollers for the tubes being angularly offset from each other around the shaft.

In the preferred embodiment, multiple tubes are arranged side by side along the inner periphery of a circular cylindrical housing and the rollers are each mounted on the end of an arm that projects radially from the shaft. Preferably there are two rollers for each tube with the two rollers being arranged diametrically opposite to each other on the shaft. The outlet of the tubes communicates with the hollow interior of the housing so that the fluid pressure at the outlet of the tubes assist in supporting the outside of the tubes.

It is a principal object of the invention to provide an efficient fluid motor using peristaltic tubes.

It is another object of the invention to provide a peristaltic motor that uses a series of tubes and rollers arranged about an output motor shaft to provide a smooth flow of power to the output shaft.

It is a further object of the invention to provide a fluid motor in which the rotation of a motor output shaft is directly proportional to fluid flow.

It is yet another object of the invention to provide a positive displacement fluid motor.

It is also an object of the invention to provide a peristaltic motor in which the flexible tubes are required to withstand only the differential in pressure that is needed to produce rotation of the motor shaft.

The foregoing and other objects and advantages will appear in the following detailed description. In the description reference is made to the drawings which illustrate a preferred embodiment of the invention.

BRIEF DESCRIPTION OF THE DRAWINGS

FIG. 3 is a view in vertical section of a portion of the motor of FIG. 1 including the inlet manifold and one of the flexible tubes and the view is taken in the plane of the line 3—3 of FIG. 1; and FIG. 4 is a view in vertical section along the length of the fluid motor and taken in the plane 4—4 of FIG. 2.

DETAILED DESCRIPTION OF THE PREFERRED EMBODIMENT

Figure 1:
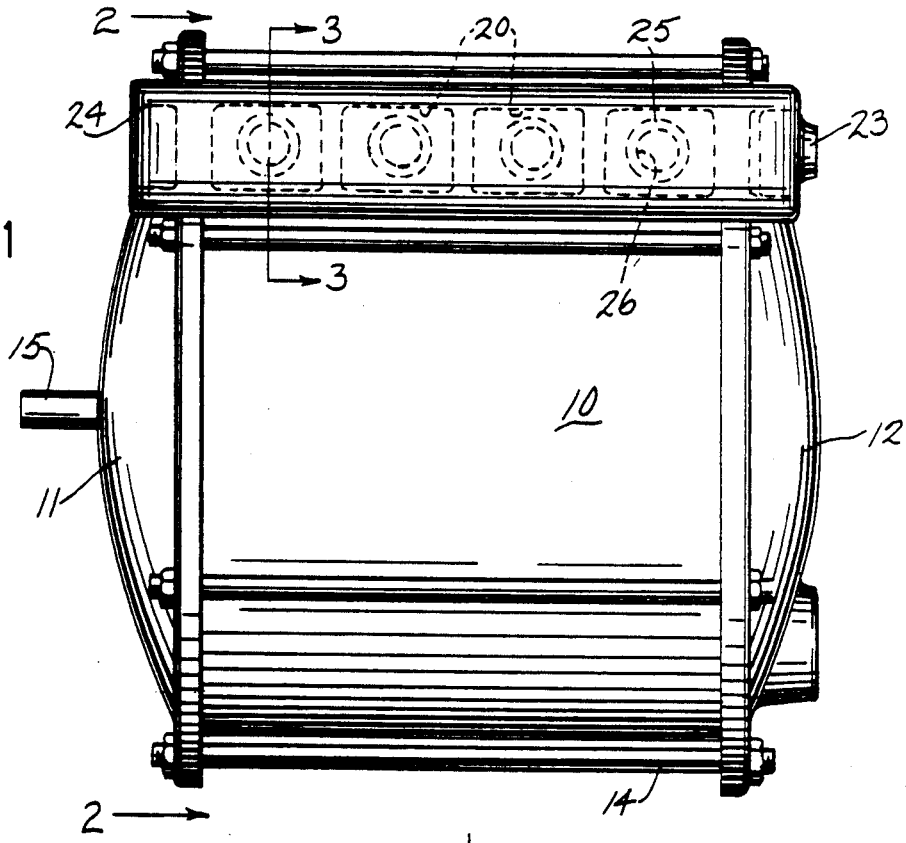
FIG. 1 is a view in elevation of a fluid motor in accordance with the invention.

Referring to the drawings, the fluid motor includes a housing formed of a circular cylindrical central body 10 with hemispherical end caps 11 and 12 that are sealed to the ends of the body 10 by O-rings 13 and which are joined to the body by through bolts 14. A motor output shaft 15 is mounted in journal bearings 16 and 17 formed in the end caps 11 and 12, respectively. The body 10 also includes an integral tangential protrusion 18 to which is attached an inlet manifold 19. The protrusion 18 has four longitudinal pocket openings 20 which lead to the hollow interior of the housing defined by the body 10 and end caps 11 and 12. One of the end caps 12 has an outlet port 21.

The manifold 19 has a through bore 22 which has a plug 23 at one end. The opposite open end of the bore 22 forms an inlet 24 for the motor. The manifold 19 has four projecting tube connectors 25 each having a central opening communicating with the through bore 22.

Figure 2:
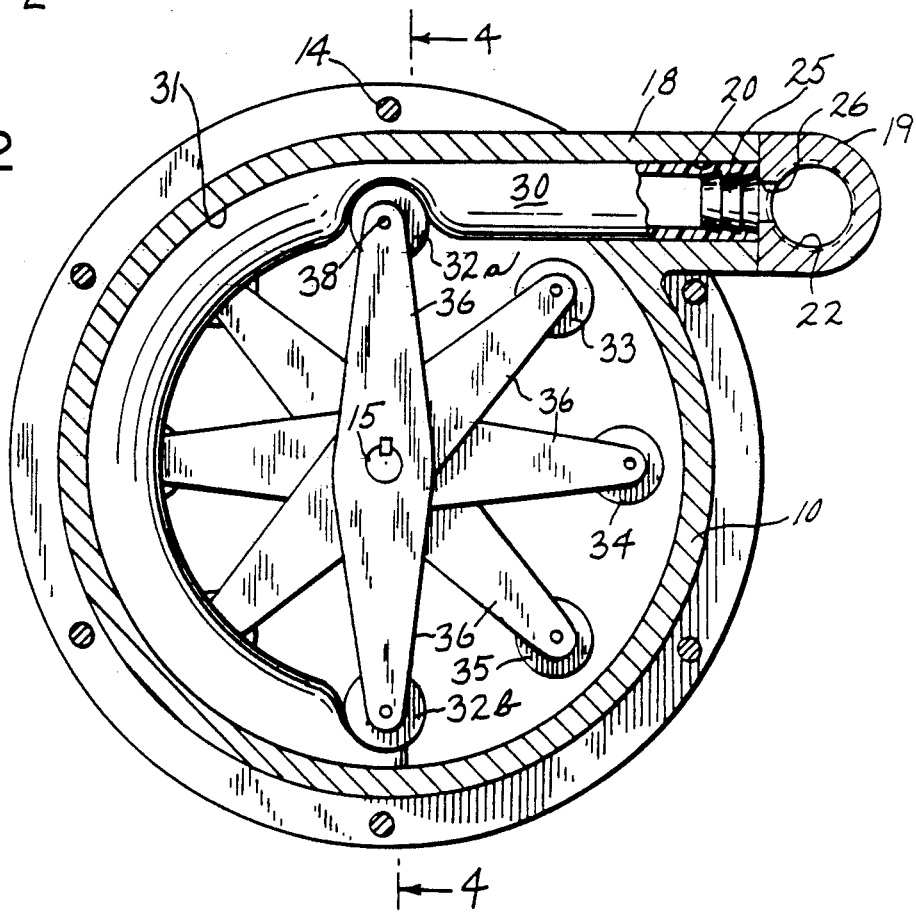
FIG. 2 is a view in vertical section through the motor and taken in the plane of the line 2—2 of FIG. 1.

Four identical flexible tubes 30 are connected at one end to the tube connectors 26 and are open at their opposite ends to the interior of the housing. The tubes 30 extend around a portion of the inner perimeter 31 of the circular cylindrical body 10. Each tube 30 is contacted by pairs of rollers 32, 33, 34 and 35. The two rollers 32*a* and 32*b* are rotatably mounted on diametrically opposite positions on the shaft by a carrier 36 which is keyed to the shaft at its center and which has spaced arms 37 that engage a shaft 38 at the axis of each roller. The arms 37 are of such a length with respect to the roller diameter that a tube 30 will be totally compressed between a roller and the support provided by the inner periphery of the body 10. As best seen in FIG. 2, the carriers 36 for the pairs of rollers 32 through 35 are angularly offset with respect to each other around the axis of the shaft 15.

A preferred material for the peristaltic tubes 30 is a non-reinforced, latex rubber having a hardness of 35 to 45 Shore A.

In operation, fluid under pressure is admitted into the inlet 24 and will flow into the inlet ends of each of the four peristaltic tubes 30. The fluid pressure will cause the rollers to advance along the length of the tubes and will thereby result in rotation of the output shaft 15. The staggered arrangement of the rollers on the tubes insures that there will be a smooth rotation of the output shaft 15 rather than the step-like rotation that would result if only a single tube were used or multiple tubes were used and the rollers were all in a line.

The fluid entering the inlet to each tube 30 will exit through the open opposite end into the hollow central cavity of the housing. The pressure of the fluid will be at a lower level than the inlet pressure by the amount necessary to perform the work of turning the motor shaft. However, this lower pressure will still be substantially greater than atmospheric pressure and the lower pressure will be applied to the exterior of the tubes 30. Thus, the tubes 30 are required to maintain a pressure differential only between the inlet pressure of the driving fluid and the interior housing pressure and this results in much less force being exerted on the tubes with the result that their life is increased.

The fluid motor is a positive displacement motor. Even a very low fluid flow at the inlet will result in rotation of the output shaft. Further, the shaft rotation is directly proportional to the fluid flow through the motor.

The fluid motor may have a variety of uses. One use is to drive a pump that adds an additive to the fluid that is used to power the motor. In such cases, the normal pressure of the fluid to which an additive is to be commingled can be employed to drive the motor pump combination without the need for a source of electricity or other power. The inlet would be connected to an upstream source of the driving fluid and the outlet of the pump would be connected to a downstream use or storage point for the driving fluid.

Another use for the fluid motor would be as a water meter with the motor inlet and outlet connected in the water line and with the output shaft connected to a dial.

The life of the tubes 30 may be extended further by yieldably mounting the rollers on the ends of the arms, such as by the use of springs, so that the rollers can exert on the tubes only such pressure as is necessary to cause the rollers to travel along the lengths of the tubes.

I claim:

1. A fluid motor comprising:
   - a hollow enclosure having a fluid inlet and a fluid outlet;
   - an output shaft journaled in the enclosure;
   - a flexible tube connected at one end to the inlet and opened at its other end to the hollow interior of the enclosure; and
   - a roller collapsing the tube and movable along the length thereof, said roller being drivingly mounted to the shaft,
   - whereby fluid under pressure at said inlet will cause the roller to advance along the length of the tube to thereby move the output shaft and the fluid will exit the tube into the hollow interior to act upon the outer surface of the tube.

2. A fluid motor in accordance with claim 1 wherein the enclosure has a circular cylindrical inner periphery and the tube is trapped between the inner periphery and the roller.

3. A fluid motor in accordance with claim 2 wherein there are a plurality of flexible tubes each connected to the inlet and open at their opposite end to the interior of the enclosure, together with a roller for each tube mounted to the shaft, the rollers for each tube being angularly offset from each other around the shaft.

4. A fluid motor in accordance with claim 3 wherein there is a pair of rollers for each tube and the rollers of each pair are diametrically opposed about said shaft.

5. A fluid motor comprising:
   - a housing having a fluid inlet and a fluid outlet;
   - an output shaft journaled in the housing;
   - a plurality of flexible tubes in the housing each communicating at one end to the inlet and at their other end being open to the interior of the housing, said flexible tubes being supported throughout their length along one side of the tube; and
   - a roller for each tube rotatably mounted on the end of an arm extending radially from the shaft, said roller extending into an opposite side of the flexible tube to compress the same.

6. A fluid motor in accordance with claim 5 wherein the arms for the rollers are equally angularly displaced about the axis of the shaft.

7. A fluid motor in accordance with claim 5 wherein said inlet includes an inlet manifold having a plurality of tube connectors arranged side by side to receive the open ends of the tubes.

8. A fluid motor in accordance with claim 7 wherein the housing has a circular cylindrical inner periphery and the tubes are trapped between the inner periphery and the rollers.

9. A fluid motor in accordance with claim 5 wherein there is a second roller for each tube mounted on the end of an arm extending radially from the shaft in a direction diametrically opposed to the arm for the first roller.

* * * * *